US012545457B2

(12) United States Patent
Biondi et al.

(10) Patent No.: US 12,545,457 B2
(45) Date of Patent: Feb. 10, 2026

(54) METHOD FOR PACKAGING ARTICLES IN BOXES AND PACKAGING DEVICE OPERATING ACCORDING TO SUCH A METHOD

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT); Marco Ghini, Bologna (IT); Luca Borderi, Bologna (IT)

(73) Assignee: R.A JONES & CO.

( * ) Notice: Subject to any disclaimer, the term of this patent is extended or adjusted under 35 U.S.C. 154(b) by 0 days.

(21) Appl. No.: 18/710,564

(22) PCT Filed: Nov. 21, 2022

(86) PCT No.: PCT/IB2022/061226

§ 371 (c)(1),
(2) Date: May 15, 2024

(87) PCT Pub. No.: WO2023/094969

PCT Pub. Date: Jun. 1, 2023

(65) Prior Publication Data

US 2025/0002191 A1 Jan. 2, 2025

(30) Foreign Application Priority Data

Nov. 24, 2021 (IT) ..... 102021000029750

(51) Int. Cl.

| | |
|---|---|
| ***B65B 43/10*** | (2006.01) |
| ***B65B 5/02*** | (2006.01) |
| ***B65B 5/04*** | (2006.01) |
| ***B65B 25/00*** | (2006.01) |

(52) U.S. Cl.
CPC ..... *B65B 43/10* (2013.01); *B65B 5/024* (2013.01); *B65B 5/04* (2013.01); *B65B 25/001* (2013.01)

(58) Field of Classification Search
USPC ..... 53/456
See application file for complete search history.

(56) References Cited

U.S. PATENT DOCUMENTS

| | | | |
|---|---|---|---|
| 3,481,098 | A | 12/1969 | Sherrill et al. |
| 4,044,528 | A | 8/1977 | Black et al. |
| 4,221,107 | A | 9/1980 | Langen |

(Continued)

OTHER PUBLICATIONS

International Search Report and Written Opinion issued for International PCT Application No. PCT/IB2022/061226 filed on Nov. 21, 2022 on behalf of R.A Jones & CO. Mail Date: Mar. 13, 2023. 10 pages.

*Primary Examiner* — Chinyere J Rushing-Tucker
(74) *Attorney, Agent, or Firm* — Steinfl + Bruno LLP

(57) ABSTRACT

A method for packaging articles in boxes includes composing a mandrel from separate units, depositing at least one article inside the mandrel, wrapping a blank around the mandrel to form a box that is at least partially closed around the article deposited in the mandrel, decomposing the mandrel in the plurality of separate units, and leaving the article inside the box. The disclosure also includes a packaging device configured to operate according to such a method.

24 Claims, 4 Drawing Sheets

(56) References Cited

U.S. PATENT DOCUMENTS

| | | | | |
|---|---|---|---|---|
| 2006/0064944 | A1* | 3/2006 | Spatafora ..... | B65B 11/32<br>53/210 |
| 2010/0330237 | A1 | 12/2010 | Deering et al. | |
| 2019/0389611 | A1 | 12/2019 | Pettersson | |

* cited by examiner

METHOD FOR PACKAGING ARTICLES IN BOXES AND PACKAGING DEVICE OPERATING ACCORDING TO SUCH A METHOD

CROSS REFERENCE TO RELATED APPLICATIONS

The present application is the U.S. national stage of International Application No. PCT/IB2022/061226 filed on Nov. 21, 2022, which, in turn, claims priority to Italian Patent Application No. 10202100029750 filed on Nov. 24, 2021.

The present invention relates to a method and device for packaging articles in boxes, that are particularly suitable for packaging articles according to a process, known in the field as "wrap-around" process, wherein the box is formed around the article to be packaged.

The content of the following Patent Applications, filed on the same date by the same Applicant, is considered as herein fully incorporated:

- Italian Patent Application No. 102021000029750 titled "Metodo di confezionamento di articoli in scatole e dispositivo di confezionamento operante secondo tale metodo";
- Italian Patent Application No. 102021000029753 titled "Metodo di confezionamento di articoli in scatole e dispositivo di confezionamento operante secondo tale metodo";
- Italian Patent Application No. 102021000029756 titled "Apparato e processo per la formazione in avvolgimento di una scatola";
- Italian Patent Application No. 102021000029759 titled "Processo e apparato per la formazione in avvolgimento di una scatola";
- Italian Patent Application No. 102021000029762 titled "Dispositivo e metodo per il confezionamento di articoli in scatole"; and
- Italian Patent Application No. 102021000029765 titled "Metodo per operare su prodotti".

The present invention is preferably, though not exclusively, applied to the field of packaging in boxes articles with a variable geometry and relatively delicate, such as bags of cereal flakes, a field to which reference will be made later without losing in generality.

In particular, in the relevant technical field, articles are known to be packaged inside a box in two distinct ways.

A first method involves a first step of forming a box, open at least at one end thereof, then introducing the article to be packaged into the open box, and then closing the open end.

A second method involves forming the box by wrapping a blank, such as a shaped and creased cardboard, around a mandrel made of a stiff material, such as metal, containing the article to be packaged. Such method involves wrapping the blank around the mandrel so as to form a box that is laterally closed but open at one end thereof, from which the mandrel is then extracted, leaving the article inside the newly formed box. In this case also, the open end may be conveniently closed, so that the resulting package may be sent to the final steps of packing and shipping to the points of sale.

In the present description as well as in the accompanying claims, some terms and expressions are deemed to have the meaning expressed in the hereinafter definitions, unless expressly stated otherwise.

The term "article" refers to any product susceptible of being packaged in boxes.

The articles may have a predefined geometric shape or they may have a variable geometry.

Preferably, the articles are food and confectionery articles, either loose or contained within bags or other types of wrapping, such as bags of cereals or capsules of coffee or other brewing drinks, individual chocolates (wrapped or naked), candies, pouches containing solid, liquid or semi-solid food articles; also, articles from the ceramic industry, absorbent articles for hygienic use, articles from the tobacco industry, articles from the cosmetics industry, articles from the pharmaceutical industry, articles from the personal & home care industry.

"Packaging" one or more articles in a box means obtaining a box containing said one or more articles. Such packaging may be obtained by introducing one or more articles in an already formed box or, preferably, may be obtained by forming a box around the one or more articles to be contained.

"Mandrel" refers to a container capable, on the one hand, of accommodating and supporting the article to be packaged and, on the other hand, of providing an effective abutment in order to fold the blank when it is wrapped around it.

For this purpose, it must be specified that accommodating and supporting the article do not imply that the article must be fully accommodated inside the mandrel or fully supported by it, but that it is as such when the blank is wrapped around the mandrel.

Similarly, it must be specified that abutting the blank does not imply that the blank must be abutted over its entire surface area by the mandrel, but that it is abutted to the extent necessary to allow for the correct folding required to form the box.

The mandrel may be composed of "separate units", referring, with such an expression, to separate mandrel portions (units), not directly connected to each other, and preferably movable independently of each other.

A mandrel is "composed" of the separate units when the latter are reciprocally positioned in such a way as to properly fulfil the mandrel functions outlined above, i.e. to accommodate and support the article to be packaged and to provide an effective abutment in order to fold the blank.

By contrast, a mandrel is "decomposed" into its separate units when it is no longer able to properly perform its functions of accommodating and supporting the article and abutting the blank.

A first element "abuts" a second element when the first element touches the second element and is able to at least partially oppose a relative displacement of the first element against the second element.

"Blank" refers to a shaped sheet of suitable material and thickness that is adapted to be wrapped by folding around a mandrel to form a box.

Preferably, the blank is made of cardboard and has creases or other weakening zones in the material (such as scores, perforations, etc.) capable of promoting the operation of folding the cardboard at predefined folding lines.

Preferably the blank has a thickness of at least 0.2 mm, more preferably less than 4 mm. Most preferably, the blank has a thickness comprised between 0.25 mm and 1.6 mm thick, more preferably between 0.3 mm and 1 mm, even more preferably between 0.4 and 0.8 mm.

"Box" refers to any container adapted to contain a plurality of articles for the purpose of packaging them, which is susceptible of being made from a blank by folding it around a mandrel and then attaching it at its edges or panels.

Preferably, the box has at least one closed-perimeter section, more preferably it is closed laterally around the mandrel while the longitudinal ends are kept open.

The Applicant preliminarily noted that the wrap-around packaging process briefly outlined above allows to obtain significant advantages in terms of production capacity and plant layout compared to the packaging process which introduces the article in the preformed box.

The Applicant further noted that the packages of articles in which the shape of the boxes deviates from the traditional parallelepiped shape are particularly sought after because of their peculiar ability to distinguish themselves in the market from the products of competitors and are therefore particularly desired by manufacturers of articles packaged in boxes.

The Applicant noted, however, that the wrap-around packaging process briefly outlined above is little suitable for manufacturing boxes with special shapes, deviating from the traditional parallelepiped shape.

The Applicant in fact verified that forming the box around the mandrel implies the need for the latter to have a shape substantially similar to that of the box being formed, in particular at its cross-section, so as to effectively abut the panels of the blank being folded around it.

However, the mandrel, after forming the box around its outer perimeter, must be pulled longitudinally out of the box, which means that the cross-section of the mandrel must not be greater than the cross-section of the box it is passing through, otherwise there is the possibility of unwanted deformation or even tearing of the box.

In particular, the Applicant verified that forming a box with cross-section reductions in median zones of the side walls or edges, such as bottlenecks or chamfers, becomes very complicated (if not impossible) to achieve by a wrap-around packaging process using a traditional mandrel.

The Applicant also noted that one solution to this problem is to use a mandrel with movable side walls, capable of bringing the side walls closer to each other to a distance of less than the dimension of the reduced section before removing the mandrel from the box.

However, the Applicant verified that this solution only partially solves the problem, as the mandrel is often limited in its ability to contract the side walls due to the presence therein of the article to be packaged.

The Applicant therefore perceived that a mandrel capable of decomposing into a plurality of separate units makes it much easier to manage the step of exiting the box once it is formed around the mandrel.

Thanks to this insight, the Applicant has fundamentally changed the traditional concept of the mandrel structure from an essentially rigid instrument, provided at most with some limited movement of its walls, to an instrument that may be assembled and disassembled when required.

The Applicant finally found that a method and device for packaging articles in boxes that involves forming a mandrel from separate units, capable of accommodating an article therein and abutting the blank while forming the closed box, and subsequently decomposing the mandrel into the starting units once these functions have been completed, allows to obtain several advantages, including that of being able to more easily extract such units from the box.

Therefore, the present invention, in a first aspect thereof, relates to a method for packaging articles in boxes.

Preferably, such a method comprises the step of composing a mandrel starting from a plurality of separate units.

Preferably, such a method comprises the step of depositing at least one article inside said mandrel.

Preferably, such a method comprises the step of wrapping a blank around said mandrel so as to form an at least partially closed box around said article deposited in said mandrel.

Preferably, such a method comprises the step of decomposing said mandrel into said plurality of separate units.

Preferably, such a method comprises the step of leaving said article inside said box.

The present invention, in a second aspect thereof, relates to a device for packaging articles in boxes.

Preferably, said device comprises a plurality of separate units.

Preferably, said device comprises a movement system of said plurality of units configured to displace said units with respect to each other between an operating position, in which said units comprise a mandrel configured to accommodate one of said articles within said mandrel and to abut a blank when it is wrapped around said mandrel while forming one of said boxes, and a non-operating position, in which said mandrel is decomposed.

Thanks to these characteristics, the packaging method and device according to the present solution allow to manufacture boxes with special shapes, which provide for a reduced cross-section in a median region of the side walls or bevelled or variously profiled edges, while still avoiding undesirable interference between mandrel and box during the step of extracting the mandrel.

They also allow to form mandrels of different dimensions by positioning the units composing the mandrel in a different way, in particular at different distances. It is thereby possible, within certain limits, to vary the dimension of the box formed around the mandrel, thus also allowing to change the format of the packages without replacing the mandrel.

The "movement system" of the separate units may be any mechanism capable of displacing the units with respect to each other between the operating position and non-operating position.

Examples of movement systems are represented by systems wherein the units are mounted on robotic arms, or are mounted on electric, pneumatic or hydraulic actuators that displace the units along straight or curved trajectories, such as cylinder and piston type actuators, or screw and nut type actuators, or slide-on-a-rail type actuators.

The present invention, in a third aspect thereof, relates to an apparatus for packaging articles in boxes.

Preferably, said apparatus comprises at least one packaging device made according to the above-mentioned first aspect.

Preferably, said apparatus comprises a moving member of said packaging device arranged to displace said packaging device along a predefined path.

Preferably, said apparatus comprises an article feeder arranged to deposit an article in said mandrel when it is composed by said units.

Preferably, said apparatus comprises a blank feeder arranged to position a blank along said predefined path so as to be abutted by said mandrel and wrapped around said mandrel containing said article.

The movement member may be any mechanism capable of displacing the packaging device along a predefined path and is represented by a conveyor driven by electric or mechanical or pneumatic or hydraulic motors or other similar known systems capable of displacing the packaging device along any trajectory, e.g. straight, curved, closed in a loop, circular.

Examples of movement members are conveyor belts, robotic arms and carousels.

The article feeder may be any device capable of introducing an article into a mandrel, as provided by the prior art.

Examples of blank feeders are represented by grippers, clamps, pushers or suction cups mounted on the arms of a carousel or on robotic arms or linear actuators; or chutes or guides within which the article is led (by push or gravity) towards the mandrel in a predefined or random manner.

The blank feeder may be any device capable of holding a blank, displacing the blank to a predefined position and releasing the blank.

Examples of blank feeders are represented by grippers, clamps or suction cups mounted on the arms of a carousel or on robotic arms or linear actuators.

The present solution, in at least one of the above-mentioned aspects, may have at least one of the following additional preferred characteristics.

Preferably, said units are movable independently of each other.

Thereby, the positioning and displacement thereof can be managed with greater flexibility.

In some preferred embodiments, said mandrel is decomposed in said plurality of units while it is still inside said box. Preferably, said plurality of units is subsequently extracted from said box leaving said article inside said box.

In an alternative embodiment, said mandrel is extracted from said box leaving said article inside said box before being decomposed into said plurality of units.

In some embodiments, said mandrel is composed by bringing said plurality of units closer to each other.

Preferably, said mandrel is composed by bringing the units of said plurality of units closer to each other to a distance of less than 50% and more preferably to a distance comprised between 10% and 30% of the dimension of said article along the direction defined by the distance between said units.

Preferably, said mandrel is composed by bringing the units of said plurality of units closer to each other to a distance of less than 200 mm, more preferably to a distance comprised between 60 mm and 170 mm.

Thereby, the units, even when positioned to compose the mandrel, remain slightly spaced from each other, which advantageously allows access to the inside of the mandrel with any mechanical member, such as suitable grippers arranged to deposit an article in the mandrel, and defines an opening that may advantageously be used for any optical inspection of the article.

In an alternative embodiment, the mandrel is formed by bringing the units into direct contact with each other.

In some embodiments, said mandrel is decomposed by moving the units of said plurality of units away from each other.

Preferably, said mandrel is decomposed by moving the units of said plurality of units away from each other to a distance greater than 50% and more preferably to a distance greater than 100% than the dimension of said article along the direction defined by the distance between said units.

Preferably, said mandrel is decomposed by moving the units of said plurality of separate units away from each other to a distance greater than 200 mm, more preferably greater than 500 mm.

In order to decompose the mandrel, the units may be moved away from each other to a suitable maximum distance such as 1 metre or 2 metres.

In some embodiments, the units of said plurality of units are reciprocally brought closer to and moved away from each other along a defined longitudinal direction on said mandrel.

Preferably, said longitudinal direction is substantially perpendicular to a direction of relative displacement of said mandrel with respect to said blank when said blank abuts said mandrel to be wrapped around said mandrel.

Preferably, said longitudinal direction and said direction of relative displacement define a plane parallel to a support surface of said mandrel on which said article is deposited.

Preferably, the support surface is a bottom of said mandrel and said longitudinal direction and said direction of displacement define a substantially horizontal plane.

In some embodiments, the units of said plurality of units are extracted separately from open, longitudinally opposed ends of said box formed around said mandrel.

It is thereby possible to conveniently form a box with a narrow cross-section in a median region thereof. In this case, it is in fact possible to configure the units in such a way that each of them can give the correct shape to the box being formed from its longitudinal end to the narrow section, without, however, going beyond it, so that the subsequent step of extracting the unit from the same end of the formed box is not hindered by interference issues.

In some embodiments, said article is retained within said box while said plurality of units is extracted from said box.

In this way, it is avoided that the item is extracted from the box together with the units.

Preferably, said plurality of units is formed by a first unit and a second unit which, even more preferably, represent two respective halves of said mandrel.

In certain embodiments, said mandrel, when composed of said units, comprises a support surface on which said article is deposited and at least one, and more preferably each of said units comprises a portion of said support surface of said mandrel.

Preferably, said packaging device comprises a first adjustment mechanism configured to vary, in at least one of said units, at least one dimension of said portion of said support surface.

This makes it possible to vary the dimension of the support surface of the mandrel, so that it can be adjusted, at least to a limited extent, according to the article to be supported or the box to be formed.

Preferably, the variable dimension is a surface dimension substantially perpendicular to the longitudinal direction of the mandrel, in other words its width.

A slight contraction of the support surface thereby leads to a narrowing of the mandrel, which may advantageously be used to further ease the extraction of the unit from the box.

In some embodiments, said mandrel, when composed of said units, comprises at least one abutment surface configured to abut said blank when it is wrapped around said mandrel to form said box.

Preferably, said abutment surface is placed laterally with respect to said support surface.

Preferably, at least one, and more preferably each of said units comprises a portion of said abutment surface of said mandrel.

The abutment surface preferably represents a side wall of the mandrel, which is preferably erected perpendicularly from the bottom of the mandrel.

In some embodiments, said packaging device comprises a second adjustment mechanism configured to vary, in at least one of said units, at least one dimension of said portion of said abutment surface.

Preferably, said mandrel, when composed of said units, comprises two abutment surfaces positioned at opposed sides of said support surface and configured to abut said blank when it is wrapped around said mandrel to form said box.

Preferably, at least one, and more preferably each of said units comprises a portion of said abutment surfaces of said mandrel.

Each unit thereby comprises a bottom portion at whose opposed sides they are erected respective side walls on which the blank is externally wrapped in order to form the box.

In a preferred embodiment, one of said side walls forms a surface of first abutment with the blank, in other words, it represents the mandrel wall that first comes into contact with the blank.

Such a first abutment surface is preferably perpendicular to said displacement direction of said mandrel with respect to said blank.

Preferably, said at least one of said units comprises a first and a second element, each one provided with a respective base plate.

Preferably, said base plates are positioned in partial overlap on top of each other.

Preferably, said base plates form said portion of the support surface of said mandrel.

More preferably, said first adjustment mechanism is arranged to slide said base plates with respect to each other so as to vary said at least one dimension of said portion of said support surface.

The first adjustment mechanism may be made by a guided coupling of a base plate (or of both base plates) to a fixed guide (e.g. fixed to the unit or to one of the two base plates) and by an element that blocks the relative sliding of the base plate (or base plates) to the guide. Alternatively, a rack-and-pinion or piston and cylinder mechanism may be provided.

In some embodiments, each of said first and second elements comprises a projection erected by said base plate.

Preferably, said projection is erected from a longitudinal edge of said base plate.

Preferably, said projection forms one of said abutment surface portions.

Each unit is thereby formed by a pair of elements each having a respective base plate and a projection erected on one side of the base plate. In particular, the elements are coupled between each other in such a way that the respective base plates are partially overlapped on opposed sides of their respective projections, so as to form a portion of the mandrel support surface, laterally delimited by opposed portions of the mandrel abutment surfaces.

In some embodiments, at least one of said units comprises an angular element, spaced from said base plate and cooperating with said first or second element to form said abutment surface portion.

Preferably, said second adjustment mechanism is arranged to change the distance of said angular element from said base plate, so as to vary said at least one dimension of said abutment surface portion.

It is thereby possible to adjust the dimension of the mandrel substantially perpendicular to the support surface, in other words its height.

This advantageously allows to adjust the corresponding dimension of the box being formed, even adapting, within certain limits, to the change in the box format.

The second adjustment mechanism may be made by displacing the angular element with respect to the projection by means of a rack or a cylinder-piston system (pneumatically or hydraulically or electrically controlled) or a guided coupling, e.g. on rods.

In some embodiments, at least one of said plurality of units is associated with a positioning element, movable with respect to said unit, and arranged to retain said article within said box when said unit is extracted from said box.

The positioning element may comprise a head, bar or other abutment element, extending transversely to the movement direction of the unit. The head may be moved with respect to the unit by swinging with respect to the side wall or bottom surface, or by translating, e.g. by means of a rod extended parallel to the movement direction of the unit.

In some embodiments, said movement member comprises a carousel rotatable around a rotation axis and said packaging device is mounted on said carousel to be displaced along a predefined substantially circular path.

In some embodiments, said units are mounted on an arm radially extended from said carousel.

Preferably, said arm passes below a working surface of said apparatus.

Preferably, said working surface extends, at least partially, along said predefined, substantially circular path.

In some embodiments, said units are mounted on said arm so that they are positioned on either side of said working surface.

In a further aspect of the present invention, a variable configuration mandrel comprising a first composed mandrel configuration and a second decomposed mandrel configuration is described, the mandrel comprising a first unit and a second unit, that may be reciprocally brought closer to and moved away from each other in a longitudinal direction, wherein:

- in the first composed mandrel configuration, the first unit and second unit are in contact or longitudinally separated from each other to a first distance not greater than 200 mm, and
- in the second mandrel decomposed configuration, the first unit and the second unit are longitudinally separated from each other to a second distance of not greater than 1000 mm,
- wherein the second distance is greater than the first distance and in the first composed mandrel configuration the first unit, second unit and first distance jointly define a support surface provided by said variable configuration mandrel.

It must be specified that some steps of the method described above may be independent of the performance order reported. In addition, some steps may be optional. In addition, some steps of the method may be performed repetitively, or they may be performed in series or in parallel with other steps of the method.

The characteristics and advantages of the present invention will become clearer from the detailed description of a preferred embodiment thereof, shown, by way of non-limiting example, with reference to the accompanying drawings wherein.

Figure 1:
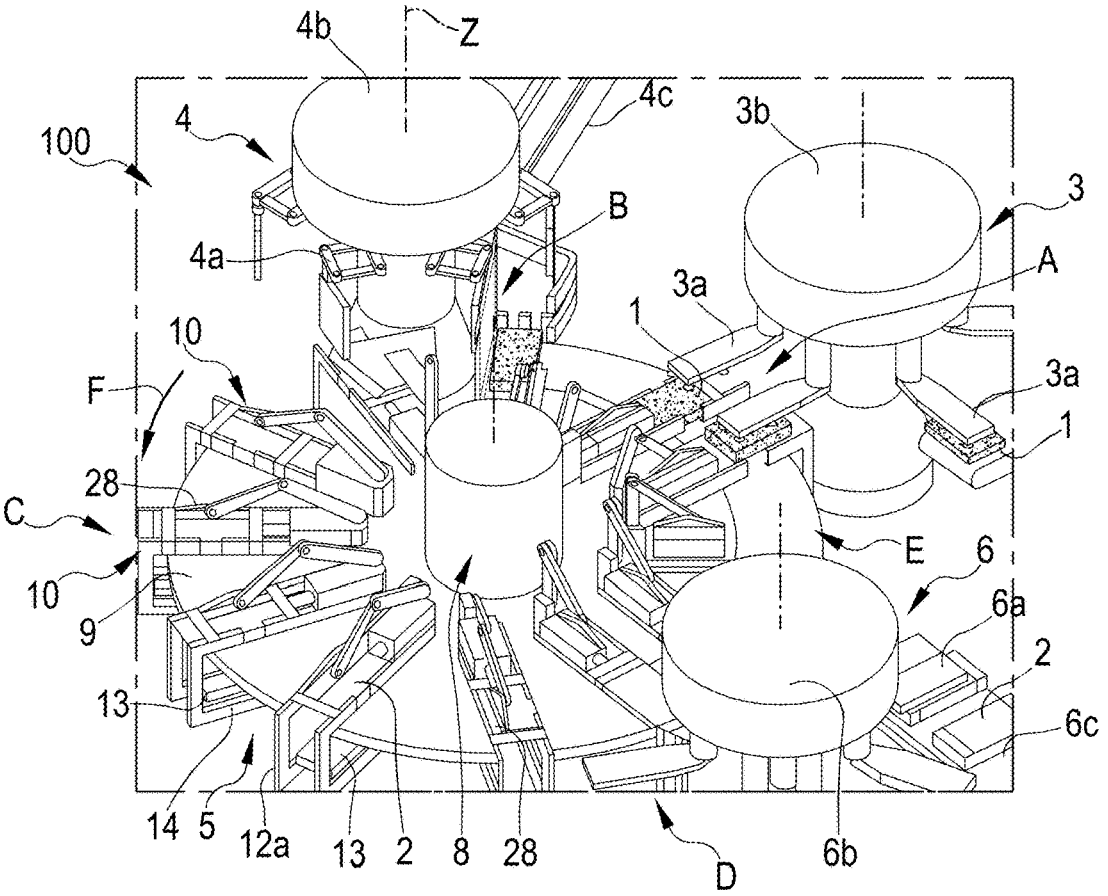
FIG. 1 is a partial schematic and perspective view from above of an apparatus for packaging articles in boxes made in accordance with the present solution.

Referring to the enclosed Figures, number 100 denotes a packaging apparatus made in accordance with the present solution.

The packaging apparatus 100 is arranged to package one or more articles 1 inside boxes 2.

The articles 1 are, in this preferred embodiment, bags of granular, loose food products, e.g cereal flakes, with a longitudinal dimension of about 300 mm.

The packaging apparatus 100 comprises, in its most general units, an article feeder 3, a blank feeder 4, a packaging unit 5, and an unloading station 6.

The article feeder 3 may be made in any form that is suitable to take an article 1 from an upstream work station (or warehouse) and deliver it to the packaging unit 5. For example, the article feeder 3 may comprise a plurality of gripping members 3*a*, such as of the suction cup type, mounted on a vertical axis carousel 3*b*.

The blank feeder 4 is in turn configured to take a single blank 7 from a set of blanks stacked in a hopper 4*c* and bring it to the packaging unit 5. For example, the blank feeder 4 may comprise a plurality of gripping members 4*a* mounted on a carousel 4*b* rotatable around an axis substantially parallel to a vertical direction, generically indicated in the Figures by Z.

The packaging unit 5 is arranged to receive the articles 1 from the article feeder 3 and form a box 2 around them from a blank 7 supplied by the blank feeder 4.

For this purpose, the packaging unit 5 comprises a plurality of packaging devices 10 which are all mounted on a carousel 8, rotatable around a vertical axis, so as to be moved along a displacement direction F defining a substantially circular path.

Thus, each packaging device 10 is led along the circular path between a receiving zone A, in which the packaging device 10 receives an article 1 from the article feeder 3, an abutment zone B, in which the packaging device 10 abuts a blank 7 supplied by the blank feeder 4, a forming zone C, in which the blank 7 is folded to form a box 2 containing the article 1, an unloading zone D, in which the box 2 containing the article 1 is delivered to the unloading station 6, and, finally, a return zone E in which the packaging device 10 is returned to the receiving zone A.

The unloading station 6 comprises, in turn, a plurality of gripping members 6*a* mounted on a carousel 6*b* with a vertical axis and arranged to take from the packaging device 10 the box 2 containing the article 1 and displace it to an exit conveyor 6*c* for subsequent working steps.

Each packaging device 10 comprises a first unit 11 and a second unit 12, distinct and separate from each other, both mounted on an arm 14 radially extended from the carousel 8 and passing below a working surface 9 of the packaging unit 5, fixed to the ground and extended along the circular path on which the packaging devices 10 are led.

In particular, the first unit 11 and the second unit 12 are mounted on the arm 14 by means of a respective upright 11*a*, 11*b* erected by the arm 14 so as to support the units 11 and 12 on opposed sides of the working surface 9 and above the level defined by it.

The first unit 11 is therefore in a radially inward position with respect to the working surface 9, while the second unit 12 is in a radially outward position with respect to the working surface 9.

The first unit 11 and the second unit 12 are substantially identical to each other and are arranged facing each other symmetrically with respect to the working surface 9.

Each packaging device 10 further comprises a movement system 13 configured to displace the first unit 11 and the second unit 12 with respect to each other between an operating position, wherein the two units 11, 12 are brought closer to each other so as to compose a mandrel 20, and a non-operating position wherein the two units 11, 12 are moved away from each other, so as to decompose the mandrel 20.

Specifically, the two units 11 and 12 are displaced between the operating position and non-operating position by sliding along the arm 14, and are therefore brought closer to and moved away from each other along a radial direction of the carousel 8, which, in this case, also corresponds to a longitudinal direction X defined on the mandrel 20.

The mandrel 20 is formed by bringing closer to each other along the longitudinal direction X the two units 11 and 12, each one representing a respective half of the mandrel 20.

In the embodiment herein described and shown, the two units 11 and 12 are brought closer to each other to a distance of about 100-120 mm, but it is also provided that, in alternative embodiments, the two units 11, 12 are brought closer together until they touch.

It will be appreciated in any case that, even without direct contact between them, when the two units 11, 12 are brought together in the operating position they form, as a whole, a mandrel, as they are capable to fulfil the functions specified for its definition, i.e. to accommodate and support the article to be packaged as well as to provide an effective abutment in order to fold the blank when it is wrapped around it.

The possibility of forming a mandrel 20 without necessarily bringing the two units 11 and 12 into direct contact also makes it possible to vary, within certain limits, the dimension of the mandrel 20 parallel to the longitudinal direction X, in other words, the length of the mandrel.

The mandrel 20, on the other hand, is decomposed by moving the two units 11, 12 away from each other along the longitudinal direction X until the non-operating position is reached.

Such position is reached when the two units 11, 12 are moved away from each other at such a distance that they cannot accommodate and support the article to be packaged, or cannot provide an effective abutment for folding the blank. In other words, in the non-operating position, the two units 11 and 12 are not considered as a mandrel altogether.

In the embodiment herein described and shown, the two units 11 and 12 when displaced to the non-operating position are moved away from each other to a distance greater than 200 mm, e.g. about 500 mm.

On the mandrel 20, composed by the two units 11 and 12 displaced in the operating position, they are identified a bottom 21, defining a support surface on which the article 1 is deposited, as well as a pair of side walls 22 and 23, delimiting the bottom 21 at the opposed longitudinal sides and defining respective abutment surfaces of the mandrel 20, configured to abut a blank 7 when wrapped around the mandrel 20 to form the box 2.

In particular, both the bottom 21 and the side walls 22, 23 are formed by respective portions provided in both the first unit 11 and in the second unit 12.

In particular, each unit 11 and 12 comprises a first element 15 and a second element 16, that are substantially L-shaped.

A respective base plate 17 and a projection 18 erected from a longitudinal edge of the base plate 17 are defined on each first and second element 15, 16.

The base plates 17 lie substantially in a horizontal plane, while the projections 18 lie substantially in a vertical plane.

The respective base plates 17 of the first and second element 15, 16 are positioned in partial overlap on top of each other with their respective projections 18 in a parallel and opposite position, thereby forming, in each unit 11, 12, both a portion of the bottom 21 and respective portions of the side walls 22 and 23 of the mandrel 20.

Each unit 11 and 12 further comprises a pair of angular elements 19, extended substantially parallel to a respective projection 18 on the side opposite the base plate 17.

Each angular element 19 has an L-shaped section, with a first wall 19*a* substantially coplanar with the projection 18, and a second wall 19*b*, substantially parallel to the base plate 17 and coplanar with the corresponding second wall 19*b* of the other angular element 19 provided in the same unit 11 or 12.

In each unit 11 or 12, the angular element 19 forms, in combination with the projection 18 lying below it, a portion of the side wall 22 or 23.

The wrapping device 10 further comprises a first adjustment mechanism (not shown in the accompanying figures) configured to displace the first element 15 with respect to the second element 16 along a direction Y, substantially perpendicular to both the vertical direction Z and the longitudinal direction X, by sliding the respective base plates 17 one over the other.

It is thereby possible to vary the dimension of the first unit 11 or the second unit 12 parallel to the direction Y, in other words its width. Consequently, when the units 11 and 12 are in the operating position, it is possible to vary the width of the bottom 21 of the mandrel 20.

The packaging device 10 also includes a second adjustment mechanism (not shown in the enclosed Figures) arranged to change the distance of the angular elements 19 from the respective base plate 17. This is achieved by raising or lowering the angular elements 19 vertically with respect to the projections 18.

It is thereby possible to vary the vertical dimension (parallel to the axis Z) of the side wall 22 and 23, in other words the height of the first unit 11 or the second unit 12.

In particular, it is provided that the angular element 19 can lower until it joins the projection 18, thus decreasing the height of the slot (until it is cancelled) formed between the angular element 19 and the projection 18.

Preferably, a projection 19*c* is provided on the second wall 19*b* of the angular element 19 that is adapted to couple with a corresponding recess 18*a* obtained in the projection 18 when the angular element 19 is lowered onto the projection 18. The provision of the projection 19*c* and the recess 18*a* gives the slot defined between the angular element 19 and the projection 18 a broken line pattern which encourages the retention of the article 1 inside the mandrel by preventing the article 1 from escaping from the side wall 22, 23 passing between the angular element 19 and the projection 18.

For this purpose, several projections and recesses, including those of different shapes and dimensions, may be obtained at the angular element 19 and the projection 18.

Both the first and second units 11, 12 are also associated with a respective positioning element 24 arranged to retain the article 1 inside the box 2 when the first and second units 11, 12 are extracted from the box.

In particular, the positioning element 24 comprises a piston with a head 26 attached at one end of a rod 25 extended longitudinally within the first unit 11 or, respectively, the second unit 12.

The head 26 is oriented in a vertical plane substantially perpendicular to the longitudinal direction X and is positioned between the projections 18 resting on (or in proximity to) the base plates 17.

Thus, when the first and second units 11, 12 are in the operating position, the mandrel 20 composed by them has a chamber for accommodating an article 1 delimited inferiorly by the bottom 21, defined by the base plates 17, laterally by the side walls 22 and 23, defined by the projections 18 and angular elements 19, and longitudinally by the heads 26 of the positioning elements 24.

The positioning element 24 is movable with respect to the respective first or second unit 11, 12 along the longitudinal direction X.

The packaging apparatus 100, with particular reference to each of its packaging devices 10, operates as described hereinafter.

The carousel 8 rotates around its vertical rotation axis Z in a continuous motion, leading the packaging devices 10 along the circular path with the first and second units 11 and 12 at radially opposed sides of the support surface 9.

Figure 2:
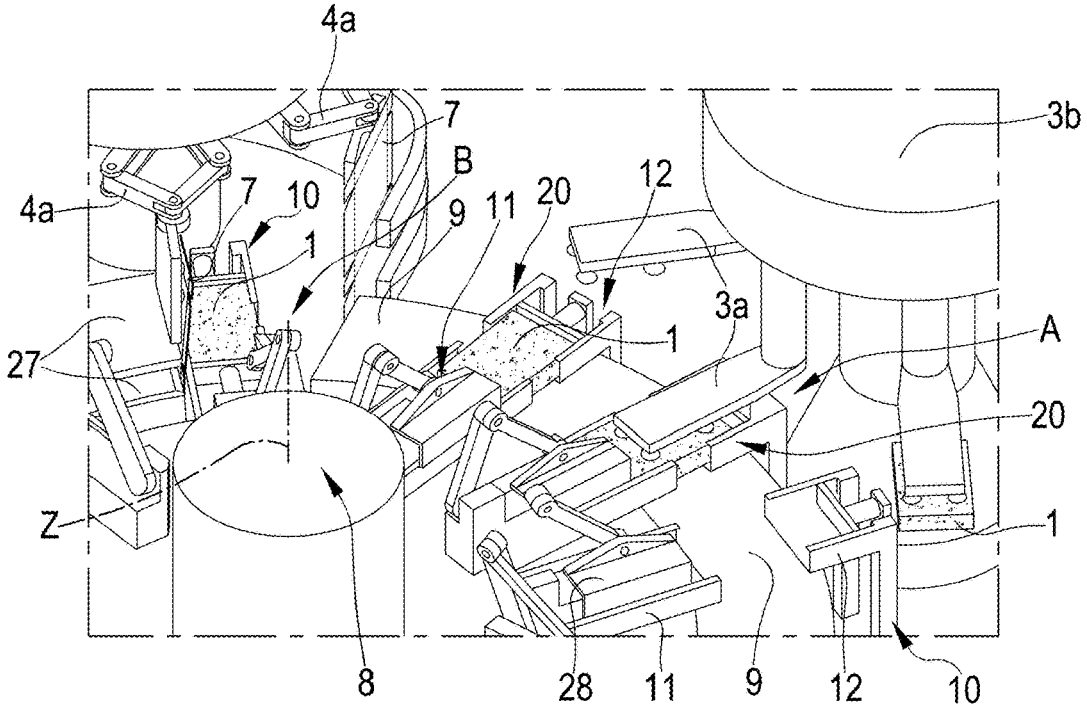
FIG. 2 is a partial schematic and perspective view from above of the packaging apparatus of FIG. 1 representing a plurality of packaging devices manufactured in accordance with the present solution in different operating configurations.

Before the receiving zone A, the movement system 13 is operated to bring the first and second units 11, 12 closer to each other and bring them into the operating position so as to compose the mandrel 20 above the working surface 9 (sequence visible in FIG. 2).

Preferably, at this stage, the first and second elements 15 and 16 of the first and second units 11, 12 are adjusted by the first adjustment mechanism to a width slightly greater than the width provided for forming the box 2, so as to ease accommodating an article 1 deposited on the bottom 21 of the mandrel 20 by a gripping member 3*a* of the article feeder 3.

Figure 4:
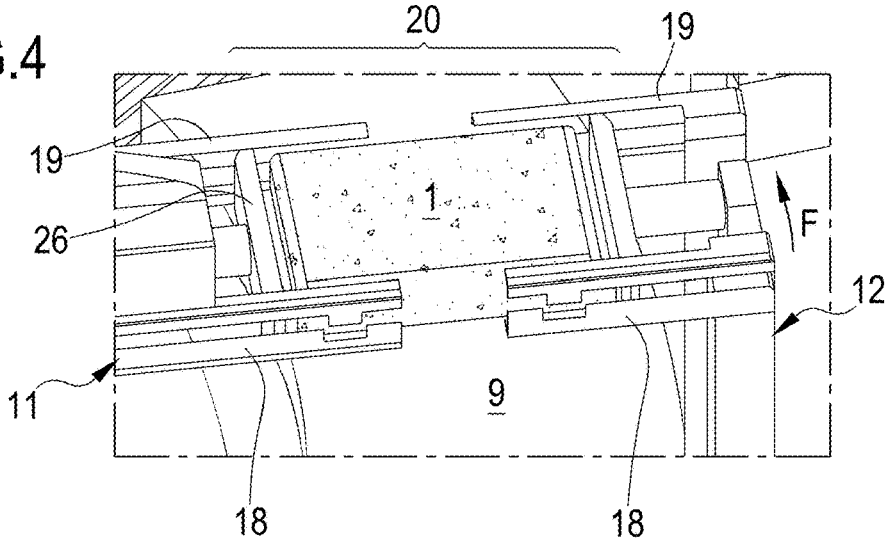

In the example herein described, only one article 1 (FIG. 4) is intended to be contained in the box 2, however, it is also possible to introduce in the box 2 a plurality of articles 1, all of which, in this case, would be deposited inside the mandrel 20 before being wrapped in the blank 7.

Once the article 1 has been deposited, the width of the bottom 21 is brought to the correct dimension by bringing the respective first and second elements 15 and 16 of the first and second units 11 and 12 closer to each other.

While the mandrel 20 is led towards the abutment zone B, the blank feeder 4 brings a blank 7 on the path of mandrel 20, at an interruption point of the working surface 9.

Figure 5:
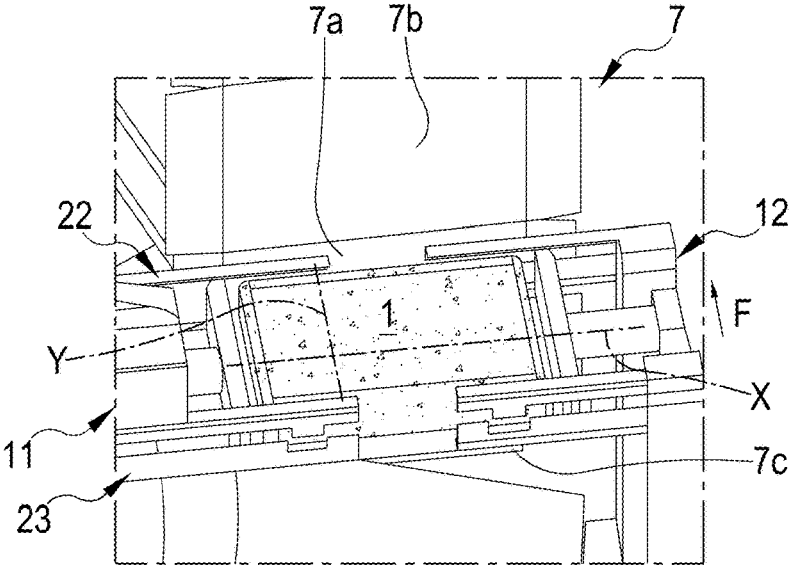

The blank 7 is positioned on a vertical plane that is substantially perpendicular to the displacement direction F, such that a central panel 7*a* of its front surface is abutted by the side wall 22 of the mandrel 20 (FIG. 5), which, thus, drags the blank 7 into the formation zone C placed immediately downstream. The side wall 22, placed in front of the mandrel with respect to its forward motion along the displacement direction F, represents the first abutment surface of the mandrel 20 with the blank 7.

The mandrel 20 then passes through a pair of plates 27 that are horizontal and spaced by a measure slightly greater than the height of the side walls 22, 23. The blank 7 is thereby pushed by the mandrel 20 between the plates 27 that fold the upper panel 7*b* and lower panel 7*c* of the blank 7 against the mandrel 20.

When exiting from the pair of plates 27, respective closing members fold the lower flap 7*d* and the upper flap 7*e* protruding from the lower panel 7*c* and the upper panel 7*b*, respectively, of the blank 7 against the side wall 23 of the mandrel 20 so as to laterally close the box 2.

Preferably, one of the two flaps is suitably provided with glue dots so that it can be attached to the other flap by gluing.

To this end, an L-shaped closing member 28 is mounted on the packaging device 10, which is lowered in a vertical plane so as to press the blank 7 against the angular element 19 of the side wall 23.

At the end of the formation zone C, the box 2 thus formed is closed laterally and open at the two opposed longitudinal ends 29*a*, 29*b*.

At that stage, in the unloading area D, the first and second units 11 and 12 are displaced to the non-operating position, moving them away from each other along the longitudinal direction X until they are completely out of the longitudinal ends 29*a*, 29*b* of the box 2.

If desired, the extraction of the units 11 and 12 from the box 2 may be further eased by slightly reducing the width of the bottom 21.

Figure 6:
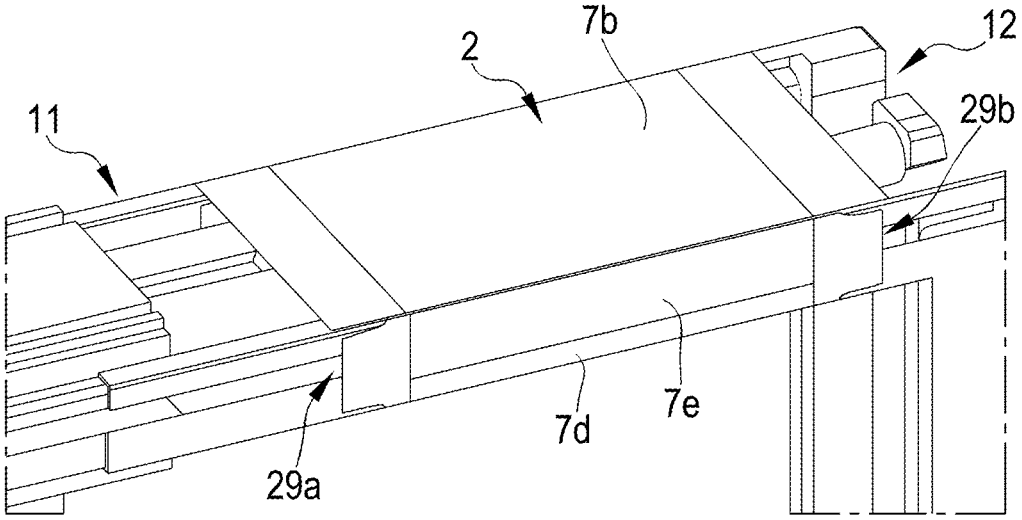
Figure 7:
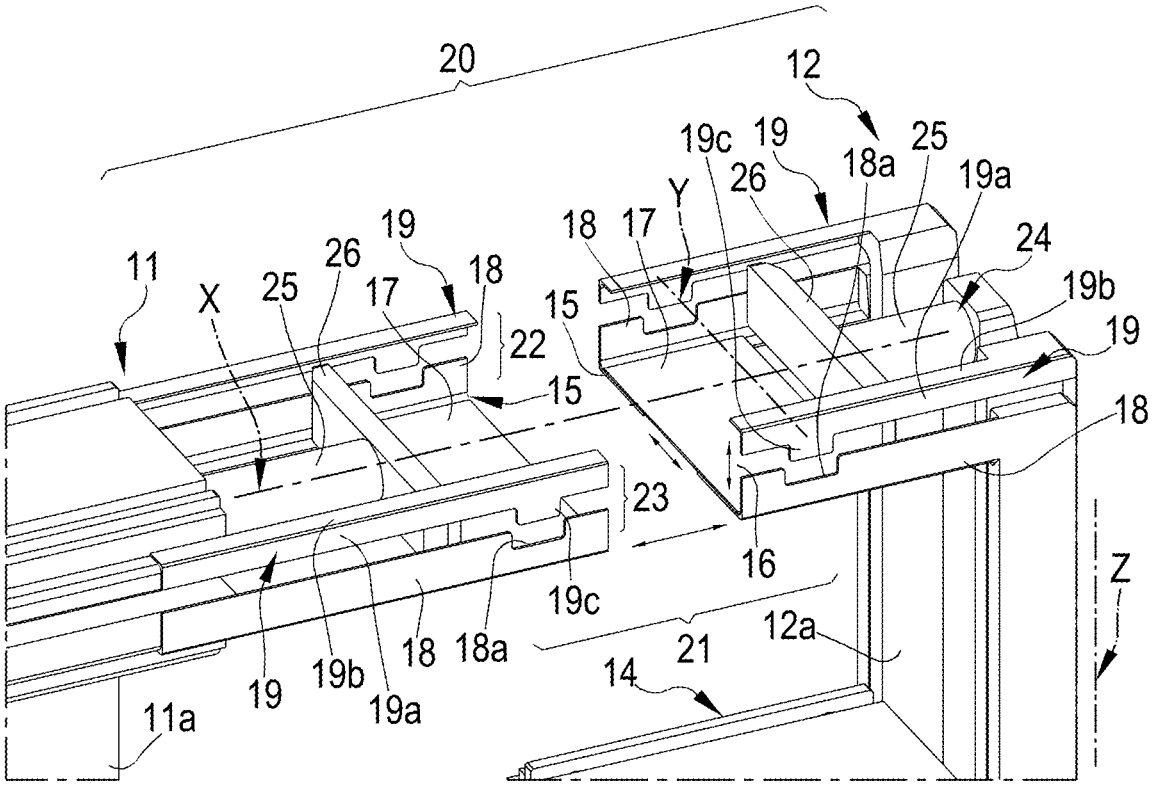
FIG. 7 is a perspective and enlarged scale view of the packaging device of FIG. 2.

At that stage, the positioning elements 24 initially remain fixed inside the box 2, so as to prevent the article 1 from being pulled out of the box 2 by the first or second units 11 and 12 (FIG. 6).

Once the first and second units 11 and 12 have been extracted from the box 2, the positioning elements 24 and the box 2 with the article 1 therein, are also extracted by the gripping members 6*a* of the unloading station 6 to be sent to the subsequent work stations, where the box 2 is closed also at the longitudinal ends 29*a*, 29*b* and is taken to the final steps of packing and shipping.

The packaging device 10, having delivered the box 2, is then led to the return zone E to be returned to the initial receiving zone A.

Figure 3:
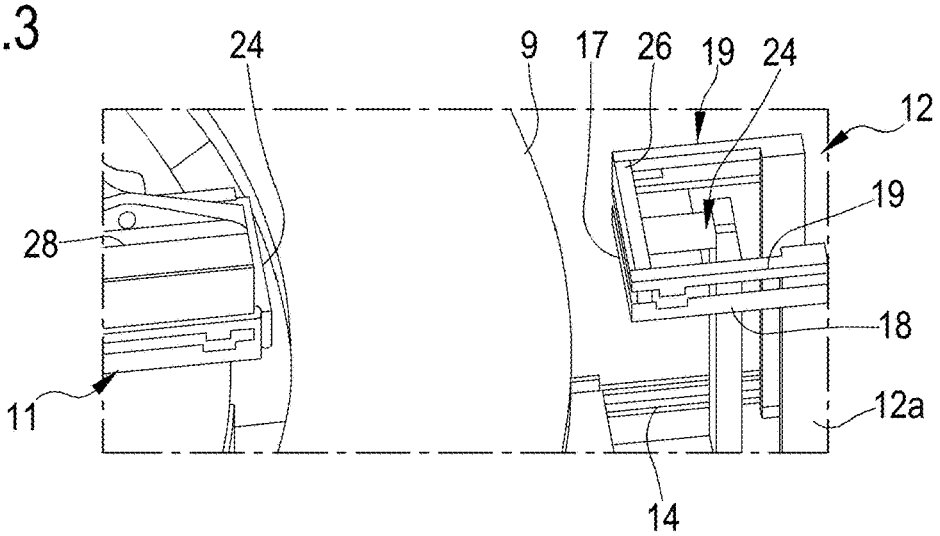
FIGS. 3 to 6 are schematic views of the packaging device of FIG. 2 in subsequent operating configurations.

In the return zone E, the first and second units 11 and 12, which have already been moved away from the non-operating position, may be independently lowered below the level of the working surface 9, so as not to interfere with any other parts of the packaging unit 5 (FIG. 3).

Figure 8:
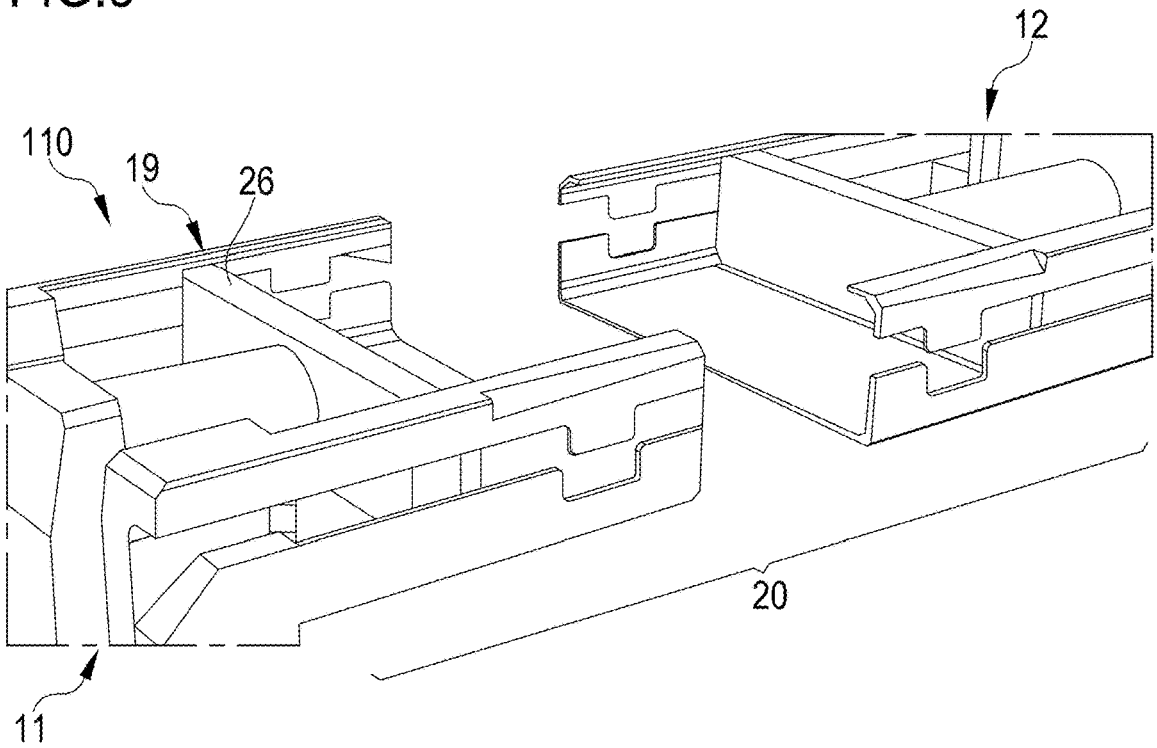
FIG. 8 is a perspective and enlarged scale view of a variant embodiment of the packaging device of FIG. 2.

FIG. 8 illustrates an embodiment variant of the packaging device, globally indicated by 110.

Compared to the packaging device 10 described in the previous example, the packaging device 110 is configured to make a mandrel 20 having side walls 22 and 23 with a different shape.

In particular, in both the first and second units 11 and 12, the angular elements 19 as well as the first and second elements 15 and 16 have at the corners a chamfer with a tapered profile starting from the end facing the positioning element 24, where the chamfer is wider, to the end facing the other unit 11, 12, where the chamfer is narrower.

Figure 9:
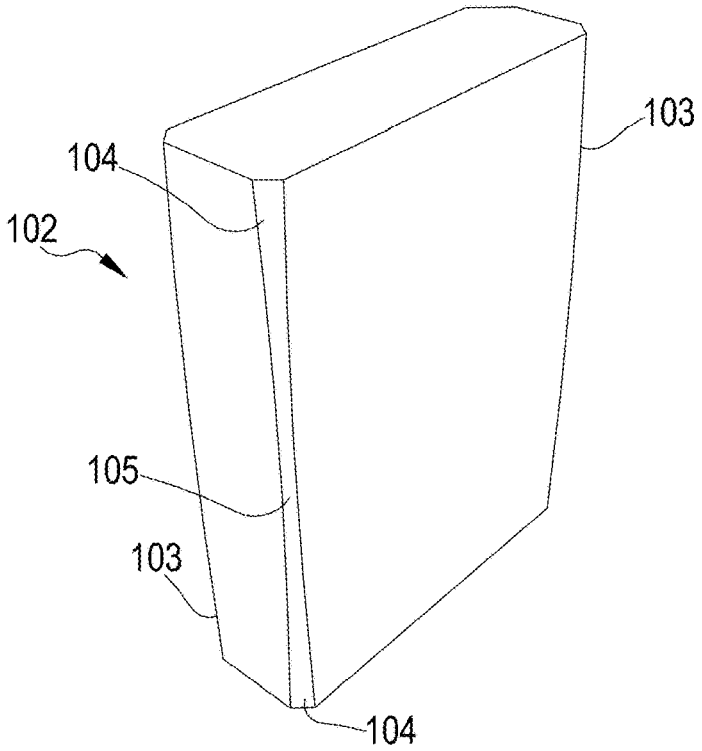
FIG. 9 is a perspective view of a package obtained with the packaging device of FIG. 8.

The packaging device 110, once mounted on the arm 14 in place of the packaging device 10, substantially operates in the same way as the packaging device 10, making it possible to obtain the box 102 shown in FIG. 9 from a suitably shaped blank 7.

As it may be seen, the box 102 has chamfered longitudinal edges 103, with the chamfer having a greater width at opposed end regions 104 and a smaller width at a median zone 105.

It will be noted that a box 102 having such profiled chamfers could not have been obtained with a traditional single-unit mandrel due to the interference between the mandrel and the box when extracting the mandrel from the box, unless the inner section of the mandrel was significantly narrowed before extraction, with the risk of damaging the product contained therein, or by using a mandrel with a narrow cross-section even when folding the blank, with the risk of not properly abutting the blank, thus creating a box with irregular edges and therefore of poor quality.

Obviously, as the articles and boxes may be of a shape and dimension similar to those indicated in the examples shown above, the dimensions and shapes of the units 11 and 12, as well as the distance at which they are brought closer to each other to form the mandrel 20, may be widely modified and adapted to suit specific needs.

The present solution thus makes it possible to solve the technical problem identified above, while at the same time achieving further advantages, including the possibility of easily adjusting one or more dimensions of the mandrel around which the box is formed.

Obviously, one skilled in the art may, in order to meet specific and contingent application requirements, make further modifications and variants to the solution described above that nevertheless fall within the scope of protection as defined by the following claims.

The invention claimed is:

1. A method for packaging articles in boxes, comprising:
composing a mandrel from separate units,
depositing at least one article inside said mandrel,
wrapping a blank around said mandrel to form a box that is at least partially closed around said at least one article deposited in said mandrel,
decomposing said mandrel into said separate units, and
leaving said at least one article inside said box.

2. The method according to claim 1, wherein the decomposing occurs while said mandrel is inside said box, the method further comprising, after the decomposing and before the leaving:
extracting said separate units from said box.

3. The method according to claim 2, wherein the extracting said separate units from said box further comprises separately extracting said separate units from open, longitudinally opposed ends of said box formed around said mandrel.

4. The method according to claim 2, wherein the extracting said separate units from said box further comprises retaining said article within said box.

5. The method according to claim 1,
the composing further comprising bringing said separate units closer to each other and
the decomposing further comprising moving said separate units away from each other.

6. The method according to claim 5, wherein the bringing said separate units closer and the moving said separate units away are reciprocally along a longitudinal direction defined on said mandrel, said longitudinal direction being substantially perpendicular to a direction of relative displacement of said mandrel with respect to said blank when said blank abuts said mandrel before the wrapping.

7. The method according to claim 1,
the composing further comprising bringing said separate units closer to each other to a distance of less than 50% of a dimension of said article along a direction of a distance between said separate units.

8. The method according to claim 1,
the composing further comprising bringing said separate units closer to each other to a distance of less than 200 mm.

9. The method according to claim 1,
the decomposing further comprising moving said separate units away from each other to a distance greater than 200 mm.

10. The method according to claim 1, wherein
said separate units are formed by a first unit and by a second unit, and
the first unit and second units are two respective halves of said mandrel.

11. A device for packaging articles in boxes, comprising:

a mandrel comprising separate units, a movement system of said separate units configured to displace said separate units with respect to each other between:

(a) an operating position, in which said separate units are configured to accommodate one of said articles inside said mandrel and to abut a blank when said blank is wrapped externally around said mandrel, and (b) a non-operating position in which said mandrel is decomposed.

12. The device according to claim 11, wherein said mandrel, when in the operating position, further comprises a support surface, and at least one of said separate units comprises a portion of said support surface of said mandrel.

13. The device according to claim 12, wherein, in at least one of said separate units, at least one dimension of said portion of said support surface is adjustable.

14. The device according to claim 13, wherein said at least one of said separate units further comprises a first element and a second element, the first element and second element provided with respective base plates, said base plates being positioned in partial overlap on top of each other to form said portion of said support surface, and wherein said base plates are slidable with respect to each other to vary said at least one dimension of said portion of said support surface.

15. The device according to claim 14, wherein each of said first element and said second element comprises a projection erected by said base plates to each form one of said abutment surface portions.

16. The device according to claim 14, wherein said at least one of said separate units further comprises an angular element, the angular element spaced from said respective base plate and cooperating with said first element or said second element to form said portion of said at least one abutment surface, and wherein a distance of said angular element from said base plate is adjustable to vary said at least one dimension of said portion of said at least one abutment surface.

17. The device according to claim 12, wherein:

said mandrel, when in the operating position, further comprises at least one abutment surface positioned laterally with respect to said support surface and is configured to abut said blank when said blank is wrapped around said mandrel to form one of said boxes; and the at least one of said separate units further comprises a portion of said at least one abutment surface of said mandrel.

18. The device according to claim 17, wherein, in at least one of said separate units, at least one dimension of said portion of said at least one abutment surface is adjustable.

19. The device according to claim 18, wherein:

said mandrel, when in the operating position, further comprises two abutment surfaces positioned on opposing sides of said support surface and is configured to abut said blank when said blank is wrapped around said mandrel to form said one of said boxes; and said at least one of said separate units further comprises a portion of each of said two abutment surfaces of said mandrel.

20. The device according to any one of claim 11, wherein at least one of said separate units is associated with a positioning element, the positioning element being movable with respect to said at least one of said separate units, and arranged to retain said one of said articles within one of said boxes when said at least one of said separate units is extracted from said one of said boxes.

21. An apparatus for packaging articles in boxes comprising:

at least one packaging device according to claim 11, a movement member of said at least one packaging device arranged to displace said at least one packaging device along a predefined path, an article feeder arranged to deposit an article in said mandrel when composed of said separate units, and a blank feeder arranged to position said blank along said predefined path, to be abutted by said mandrel and wrapped around said mandrel containing said article.

22. The apparatus according to claim 21, wherein said movement member comprises a carousel rotatable around an axis of rotation and said at least one packaging device is mounted on said carousel to be displaced along a predefined substantially circular path.

23. The apparatus according to claim 22, wherein said separate units are mounted on an arm, the arm being radially extended from said carousel, passing below a working surface of said apparatus, and extended at least in part, along said predefined substantially circular path.

24. The apparatus according to claim 23, wherein said separate units are mounted on said arm to be positioned on either side of said working surface.

* * * * *